United States Patent [19]

Claesson

[11] 4,391,258

[45] Jul. 5, 1983

[54] ARRANGEMENT FOR DRIVING A MECHANISM IN AN INTERNAL COMBUSTION ENGINE

[75] Inventor: Dick V. Claesson, Södertälje, Sweden

[73] Assignee: Saab-Scania Aktiebolag, Sodertalje, Sweden

[21] Appl. No.: 238,654

[22] Filed: Feb. 26, 1981

[30] Foreign Application Priority Data

Mar. 6, 1980 [SE] Sweden ..... 8001778

[51] Int. Cl.[3] ..... F02M 37/04

[52] U.S. Cl. ..... 123/508

[58] Field of Search ..... 123/507–509; 417/364; 92/129; 74/569

[56] References Cited

U.S. PATENT DOCUMENTS

| | | | |
|---|---|---|---|
| 2,000,555 | 5/1935 | Becker | 123/508 |
| 2,231,264 | 2/1941 | Friedrich et al. | 123/509 |
| 2,733,619 | 2/1956 | Smith | 74/569 |
| 3,152,584 | 10/1964 | Petroff | 123/508 |

FOREIGN PATENT DOCUMENTS

| | | | |
|---|---|---|---|
| 539801 | 7/1922 | France . | |
| 340892 | 5/1936 | Italy | 123/508 |
| 1209838 | 10/1980 | United Kingdom . | |

*Primary Examiner*—Craig R. Feinberg

*Attorney, Agent, or Firm*—Cushman, Darby & Cushman

[57] ABSTRACT

The present invention relates to an arrangement for mechanically driving a mechanism connected to an internal combustion engine. A push rod is mounted between the mechanism and a shaft rotatably mounted in the engine, one end of said rod being adapted to actuate the mechanism and the other end being adapted to resiliently engage against an arcuate surface on said shaft and to be given oscillating translation motion by said shaft on rotation. The invention is distinguished in that the end of the push rod engaging against the shaft is provided with two extensions at least partially embracing the arcuate surface on the shaft, said extensions guiding the position of a rod in a plane transverse to the shaft when said shaft rotates. The push rod thus requires no extra guidance and is simple to fit and to dismantle. The push rod preferably comprises two parts joined to each other via a jointing sleeve allowing a given degree of angular latitude between said parts. The arrangement is applicable to driving fuel pumps in internal combustion engines.

7 Claims, 1 Drawing Figure

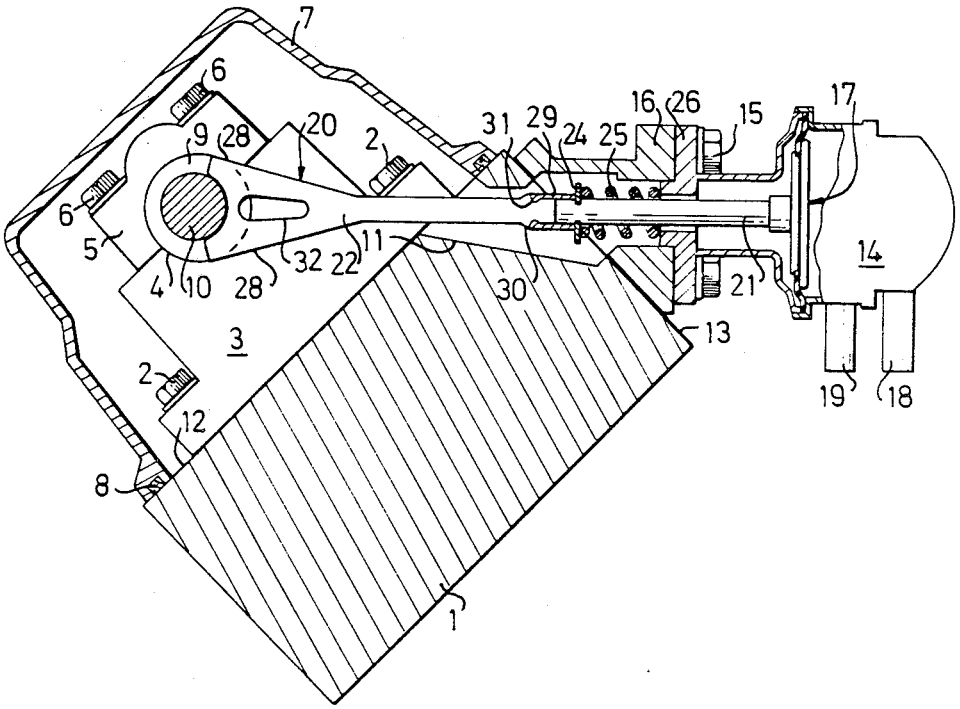
7
6
9
28
20
2
31
29
24
25
16
26
15
17
6
5
4
10
28
32
22
11
30
21
14
3
13
2
12
19
18
8
1

ARRANGEMENT FOR DRIVING A MECHANISM IN AN INTERNAL COMBUSTION ENGINE

The present invention relates to an arrangement for mechanically driving a mechanism connected to an internal combustion (IC) engine, a push rod being adapted between the mechanism and a shaft rotatably mounted in the engine, one end of said push rod being adapted to actuate the mechanism and the other end of said push rod being adapted for resiliently engaging against an arcuate surface on the shaft and to be given an oscillating translation motion by said shaft on rotation.

It is previously known to apply such arrangements in driving fuel pumps for IC-engines. The pump is often a diaphragm pump, which can be driven entirely mechanically via different intermediate means in the form of push rods, rocker arms and the like. Said means is caused by means of springs to engage against a cam or an excentric surface on a rotating shaft, thereby to be given an oscillating motion which is transferred to the diaphragm in the pump.

It is also known to drive diaphragm pumps by means of arrangements similar to a crank and driving rod, a rod being formed as a connecting rod and attached to a crank shaft-like portion on a rotating shaft. In such arrangements the rod motion is entirely controlled, and thus there is no need of a spring to actuate the rod.

Known arrangements for driving mechanisms connected to IC-engines, e.g. fuel pumps, have several disadvantages, however. The first-mentioned type of motion translation, in which a sprung push rod engages against an eccentric requires that the rod must be centered in the radial direction of the rod. This results in more or less complicated guides which require relatively expensive and voluminous arrangements for driving these mechanisms. These drawbacks become even more outstanding in the class where the mechanism is placed at a large distance from the drive shaft and thereby requires a relatively long rod.

In the other type of motion translation, a rod similar to a connecting rod is used, and this causes considerable problems as regards the attachment to the rotating shaft.

The present invention has the object of eliminating the mentioned disadvantages and relates to an arrangement which substantially simplifies driving a mechanism connected to an IC-engine, the invention being substantially distinguished in that the end of the push rod engaging against the shaft is provided with two extensions which at least partially embrace the arcuate surface on the shaft, and that said extensions guide the position of the push rod in a plane transverse to the shaft when the shaft is rotated.

The inventive push rod is automatically centered to the driving shaft and this results in that no further guiding is required, not even in the cases where the mechanism must be placed at a relatively large distance from the shaft for safety or structural reasons. The manufacturing costs for the inventive arrangement are comparatively low, since the push rod is preferably manufactured from a stamped-out metal plate, and the driving shaft only requires minimum machining.

Further distinguishing features and advantages of the invention are disclosed in the following description of an embodiment exemplifying the invention, for driving a fuel pump connected to an IC-engine.

The description is carried out with reference to an accompanying drawing showing by a FIG. 1 a cross-section of the necessary means for driving a fuel pump of an IC-engine.

A cylinder head 1 for a conventional IC-engine is schematically shown in the FIGURE. A cam shaft support 3 is attached to the cylinder head 1 by means of bolts 2. A cam shaft 4 is rotatably mounted in said cam shaft support and is held in place by means of a plurality of bearing caps 5, attached by bolts 6 to the support 3. The cam shaft 4 is intended conventionally to control and actuate the engine valves and is driven by the engine crank shaft via a conventional chain drive (not shown). The cam shaft 4 is protected by a valve cover 7 screwed down to the cylinder head 1 with a packing 8 between the cover 7 and head 1.

In the vicinity of its one end, the cam shaft 4 is formed with a periferal groove 9 the depth of which varies around an inner cylinder surface 10 on the cam shaft 4, said cylinder surface being eccentric in relation to the centre line of said shaft. A push rod 20 is intended to engage in said groove 9, for transferring operational motion to a fuel pump 14.

For the last-mentioned purpose, the cylinder head 1 is at a position in register with the position of the groove 9 on the cam shaft 4, provided with a duct 11 between the upper surface 12 and one side surface 13 of the cylinder head 1. The fuel pump 14 is mounted on the side surface 13 in line with said duct 11. Mounting of the fuel pump 14 is accomplished by means of a plurality of bolts 15 which attach to an intermediate bracket 16, in turn attached to the side surface 13 by means of a bolted joint (not shown).

The fuel pump 14 is a diaphragm pump containing a diaphragm 17 which, on oscillating axial movements, pumps fuel from an inlet pipe 18 to an outlet pipe 19 on the pump 14 for further conveyance to the engine. Said diaphragm pump 14 is otherwise conventionally formed, and since closer knowledge of its construction is not required for understanding the present invention, it is not described further.

The abovementioned push rod 20 is connected at its one end to the diaphragm 17 of the pump 14, and its other end is adapted for engagement against the cylindrical surface 10 in the groove 9 on the cam shaft 4. The push rod 20 is made up from two parts 21,22, one part 21 being attached to the pump diaphragm 17 while the other part 22 engages against the surface 10 on the cam shaft 4. The part 21 of the push rod 20 is a round bar, at its outer end provided with a periferal groove for a lock washer 24. Against this lock washer there is seated one end of a compression spring 24, the other end of which engages against a part formed as a flange on the pump housing 26. This signifies that the compression spring 25 urges the push rod 20 into engagement against the surface 10 on the cam shaft 4.

The other part 22 of the push rod 20 is a stamped-out metal plate, and the end engaging against the cam shaft 4 is formed with an arcuate engagement surface. The radius of this surface is substantially complementary to the radius of the cylindrical surface 10 on the cam shaft 4. The arcuate surface thus extends between two extensions 28 which can be regarded to provide a fork configuration at the outer end of the push rod 20. Said fork configuration enables simple assembly and dismantling of the push rod 20 in relation to the cam shaft 4.

The two parts 21 and 22 of the push rod 20 are mutually joined by means of a jointing sleeve 29 of at least partially elastic material, e.g. a glass fibre reinforced plastics material. The part 22 engaging against the cam shaft 4 is formed at its inner end with two abutments 30 and two recesses 31 against and in which the jointing sleeve 29 engages. In respect of this, the jointing sleeve 29 is formed with an annular collar fitting the recesses 31, thereby to lock the sleeve 29 relative the push rod part 22. The part 21 of the push rod 20 connected to the pump diaphragm 17 fits into the other end of the jointing sleeve 29, thereby a certain radial play can be present so that the two parts 21, 22 of the push rod can form an angle to each other within certain limits.

An arrangement formed in the described mode for driving a fuel pump 14 results in that when the cam shaft 4 is rotated the push rod 20 is given a longitudinal oscillating motion which urges the diaphragm 17 to execute pumping movements. Simultaneously therewith the push rod 20 will also execute movements in the transverse direction of the push rod 20. Such transverse movements are taken up by the play between the jointing sleeve 29 and the push rod part 21, the latter thus not being affected by any transverse forces.

By the push rod 20 being formed with an arcuate engagement surface against the cam shaft 14, the push rod 20 will be self-centering relative the cylinder surface 10 on the cam shaft 4. As a result of this, and also due to the fork configuration, no extra guidance of the push rod 20 is required. The groove in the cam shaft 4 is preferably formed with a width which is only somewhat larger than the thickness of the push rod part 22 arranged in the groove 9. This results in that the push rod 20 is given guidance in the longitudinal direction of the cam shaft 4 and no extra guidance is needed in the axial direction.

The cam shaft 4 and its mountings are lubricated by means of a conventional pressure lubrication system, which signifies that the whole of the cam shaft 4 is directly or indirectly coated with lubricating oil. The result of this is that the surface between the push rod 20 and the cam shaft 4 also obtains satisfactory lubrication.

The groove 9 in the cam shaft 4, which takes up very little axial length, can also be formed at other places along the length of the cam shaft 4, and the fuel pump 14 can thus be placed in advantageous positions with respect to construction and safety.

As previously mentioned, the push rod 20 can be easily fitted and dismantled. In such an operation, the push rod 20 is urged towards the fuel pump 14, the push rod 20 thus being brought out of its position in the groove 9. To facilitate this, the rod 20 is preferably formed with an elongate slot 32 in which a screw driver or the like can be fitted for easily getting a grip on said rod 20.

The present invention can be modified and formed in other modes than what has been said before in the descriptive example above, within the scope of the following patent claims. Neither is the invention limited solely to driving a fuel pump but in principle any mechanism which is driven by an oscillating translation motion can be driven by means of the inventive arrangement, any axle at all being used for driving.

What I claim is:

1. In apparatus for mechanically driving a mechanism associated with an internal combustion engine: a driven rotatable shaft having a rotation axis, said shaft having a peripheral groove which has side walls and a bottom wall forming a continuously curved cam surface which is eccentric to the rotation axis of said shaft; a push rod having a first end drivingly connected to said mechanism and a second end having a fork configuration including two extensions which are oriented radially on either side of the cam surface and, between said extensions, a curved surface engaging said cam surface so that rotation of said shaft imparts oscillating axial motion to said push rod and swinging movement to said second end of said push rod, said two extensions residing in said groove and being engageable with the side walls of said groove whereby said swinging movement of said second end of said push rod is accommodated, whereby said second end of said push rod is guided by said side walls in the longitudinal direction of said shaft and whereby no extra guidance is needed in the axial direction of said push rod, wherein said push rod comprising first and second longitudinal portions and means connecting said first and second portions in end-to-end relationship in a manner to accommodate angular play during said transverse movements of said first end, said first longitudinal portion incorporating said first end and said second longitudinal portion incorporating said second end.

2. Arrangement for mechanically driving a mechanism connected to an internal combustion engine, a push rod being adapted between the mechanism and a shaft rotatably mounted in the engine, one end of said push rod being adapted for actuating the mechanism and another end of said push rod being adapted for resiliently engaging against an arcuate surface on the shaft and to be given oscillating translation motion by said shaft on rotation, characterized in that the arcuate surface on the shaft is located in a peripheral groove in the shaft, the end of the push rod engaging said arcuate surface having two extensions reaching into said groove and at least partially embracing said arcuate surface, for controlling the position of said push rod end radially and axially in relation to the axis of rotation of said shaft, the push rod comprising a first push rod part incorporating said extensions and a second push rod part forming said one end being connected with said first push rod part via an angular play-permitting jointing sleeve, wherein the extensions are oriented radially on either side of the arcuate surface on the shaft and wherein the extensions are at least partially provided with arcuate surfaces engaging against the arcuate surface on the shaft.

3. Arrangement as claimed in claim 2, characterized in that the arcuate surface on the shaft is an eccentrically located cylindrical surface.

4. Arrangement as claimed in claim 2, characterized in that said first push rod has a length, which is considerably greater than the width between its extensions.

5. Arrangement as claimed in claim 4, characterized in that the jointing sleeve is connected with play to one of said first and second push rod parts whereby the first and second push rod parts can be given a mutual angular attitude.

6. Arrangement as claimed in claim 5, characterized in that the mechanism is a diaphragm-type fuel pump.

7. Arrangement as claimed in claim 6, characterized in that the driving shaft is the cam shaft of the internal combustion engine.

* * * * *